United States Patent [19]

Thomas et al.

[11] Patent Number: 5,054,543

[45] Date of Patent: Oct. 8, 1991

[54] EXPANSION JOINT FOR ROTARY IRONERS

[75] Inventors: Ronald Thomas, Chicago; Kasimir Kober, Niles, both of Ill.

[73] Assignee: Chicago Dryer Company, Chicago, Ill.

[21] Appl. No.: 469,325

[22] Filed: Jan. 24, 1990

[51] Int. Cl.[5] ..... F28F 5/02; F26B 11/04

[52] U.S. Cl. ..... 165/89; 165/81; 34/124

[58] Field of Search ..... 165/89, 90, 81; 34/124, 34/125; 100/93 RP

[56] References Cited

U.S. PATENT DOCUMENTS

| | | | |
|---|---|---|---|
| 2,063,490 | 12/1936 | Davis | 165/81 |
| 2,232,936 | 2/1941 | Bimpson | 165/81 |
| 2,322,957 | 6/1943 | Sullivan | 38/49 |
| 2,344,269 | 3/1944 | Saco, Jr. | 165/81 |
| 2,498,662 | 2/1950 | Eaby | 165/89 |
| 2,628,433 | 2/1953 | Ostertag | 34/124 |
| 2,678,600 | 5/1954 | Allen | 100/93 S |
| 2,701,518 | 2/1955 | McDonald | 100/93 S |
| 2,915,293 | 12/1959 | Justus | 165/1 |
| 2,987,305 | 6/1961 | Calhoun | 432/31 |
| 3,060,592 | 10/1962 | Ostertag | 165/89 |
| 3,169,050 | 2/1965 | Kroon | 34/124 |
| 3,331,434 | 7/1967 | Lockhart | 165/89 |
| 3,625,280 | 12/1971 | Peter | 165/90 |
| 3,634,956 | 1/1972 | Behn | 38/1 R |
| 3,939,763 | 2/1976 | Sato | 100/93 S |
| 3,956,348 | 8/1956 | Meuller | 34/124 |
| 4,197,663 | 4/1980 | Riedel | 38/3 |
| 4,282,639 | 8/1981 | Christ | 29/116.2 |
| 4,359,829 | 11/1982 | Schiel | 34/124 |
| 4,418,486 | 12/1983 | Kamberg | 38/58 |
| 4,485,573 | 12/1984 | Kamberg | 38/44 |
| 4,677,773 | 7/1987 | Kamberg | 38/44 |
| 4,819,438 | 4/1989 | Schultz | 165/81 |

FOREIGN PATENT DOCUMENTS

| | | | |
|---|---|---|---|
| 472331 | 3/1951 | Canada | 165/90 |

*Primary Examiner*—John Rivell
*Assistant Examiner*—L. R. Leo
*Attorney, Agent, or Firm*—Joseph P. Calabrese

[57] ABSTRACT

An expansion joint is provided for a rotary ironer or the like employing concentric cylinders defining a passageway through which thermal liquid passes. The joint comprises a toroidal segment which is secured in fluid-tight engagement to adjacent ends of the concentric cylinders. The provided joint enables one cylinder to be heated in advance of the other and expand while retaining a fluid-tight connection between the cylinder ends.

8 Claims, 3 Drawing Sheets

FIG. 2
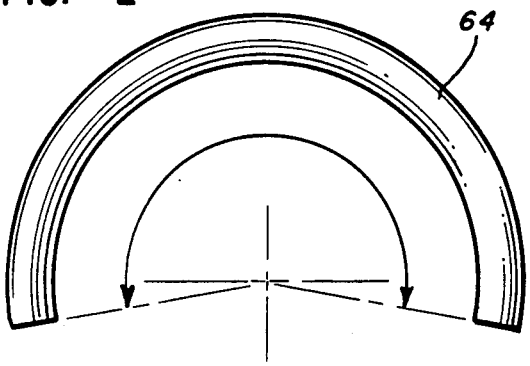
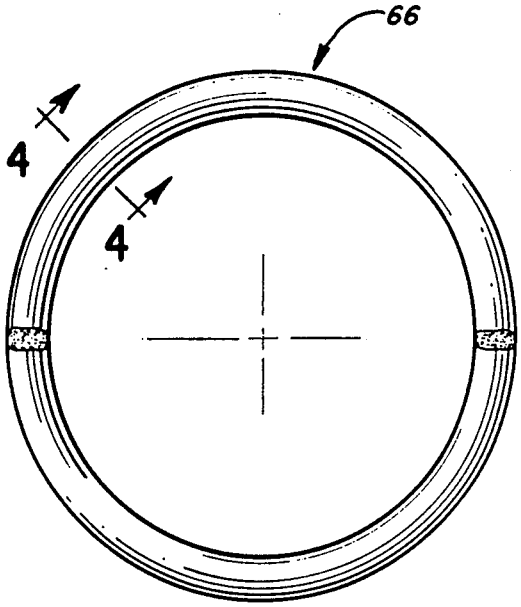
FIG. 3
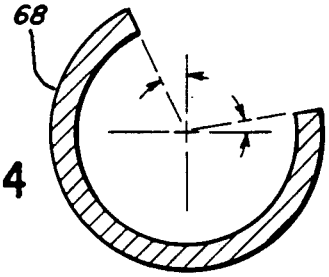
FIG. 4
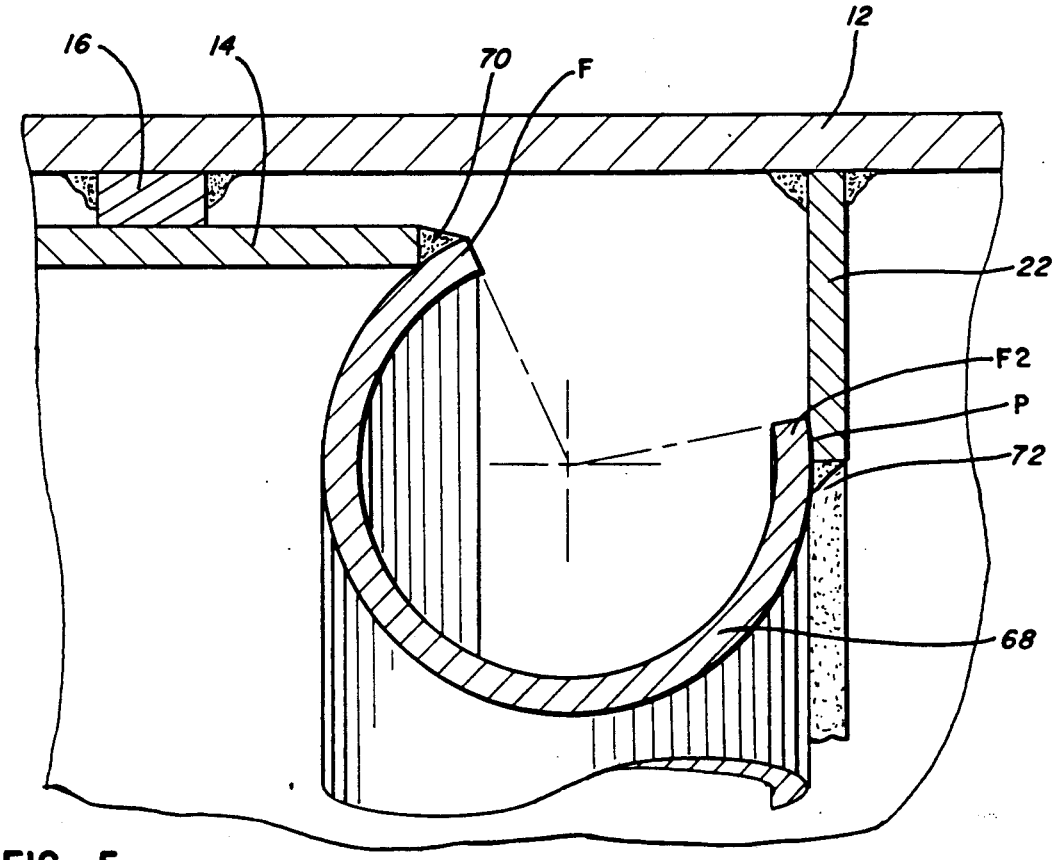
FIG. 5

FIG. 6
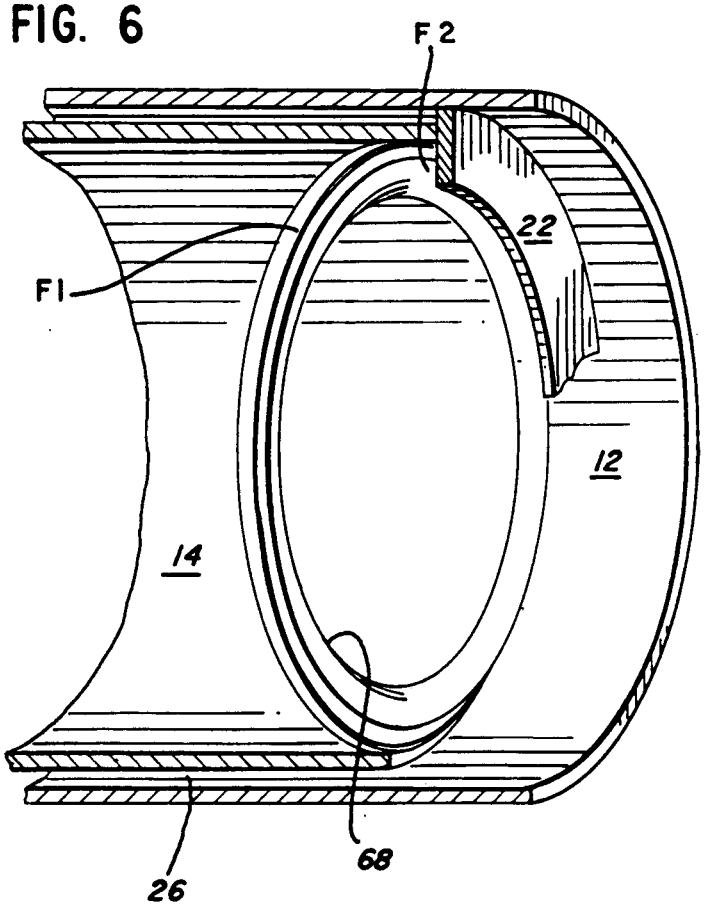
FIG. 7
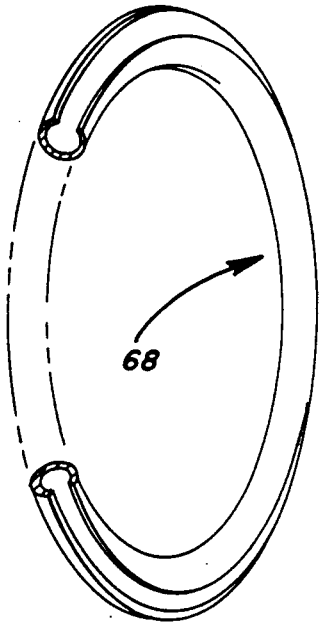
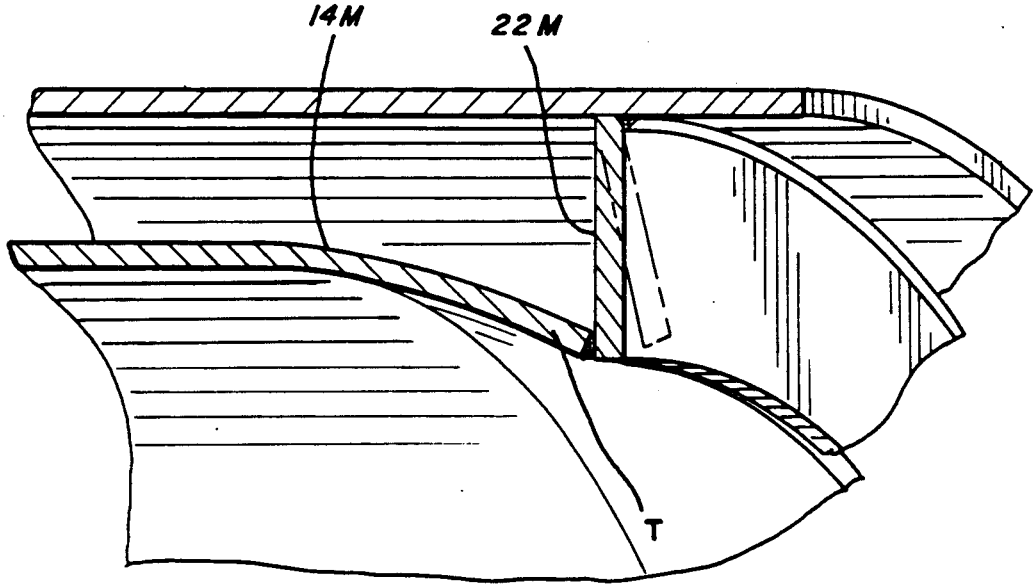
FIG. 8

EXPANSION JOINT FOR ROTARY IRONERS

BACKGROUND OF THE INVENTION

1. Field of the Invention

This invention relates to rotary cylindrical ironers comprising concentric cylinders having a cylindrical passageway through which a heated liquid passes. More particularly, this invention pertains to a liquid-tight joint adapted for use between the ends of the cylinders of such ironers.

2. Description of the Prior Art

The use of a heated fluid passing through the inner cylindrical passageway of a jacketed rotary cylindrical ironer is well known in the art. Thus Sullivan U.S. Pat. No. 2,322,957 discloses a direct fired flatwork ironer having such cylindrical passageways in which the fluid medium passing between concentric cylinders defining such passageway is heated by direct flame infringement against the inner periphery of the inner cylinder of such ironer.

Kroon U.S. Pat. No. 3,169,050 is directed to a rotary drying drum having a shell through which a heating fluid is circulated. Such dryer employs pivotally connected links for permitting movement of the inner cylinder relative to an outer drum. Such movement is necessitated by heat expansion in the normal course of operation. Replaceable packing effects seals at drum ends which define the limits of a cylindrical passageway through which a fluid heating medium circulates.

Lockhart U.S. Pat. No. 3,331,434 is directed to a jacketed heat transfer roll employing a thermal liquid. The Lockhart roll rotates with its own reservoir of liquid, is internally heated and relies upon centrifugal force to distribute heated liquid through the roll jacket and assist in maintaining desired uniformity of roll temperature.

Kamberg U.S. Pat. No. 4,485,573 discloses an internally heated, jacketed ironing roll employing concentric cylinders, but does not suggest any means for contending with differences in such cylinder expansion in the normal course of roll operation.

The prior art is thus seen to be familiar with rotary drying rolls comprising concentric cylinders defining a passageway through which a fluid medium passes. The prior art also discloses such a jacketed cylinder which is internally heated by direct flame infringement. As the inner cylinder is first heated, it will expand relative to the spaced-apart outer cylinder. It is therefore necessary that seals be present at the cylinder ends which may cope with differences in cylinder expansion without leakage of the heating medium passing between the cylinders. However, the prior art fails to disclose or suggest a simple and effective joint between the ends of such heated concentric cylinders which is fluid-tight and easily manufactured and maintained.

It is an object of this invention therefore to provide a jacketed ironing roll construction which employs an expansion joint formed from pipe in the form of a toroidal segment which is welded between the ends of concentric cylinders.

It is another object of this invention to provide an expansion joint for use with a jacketed cylinder of an ironing apparatus which is rugged and durable although composed of a minimum of simple elements.

It is a further object of this invention to provide a modified expansion joint construction for use with an internally heated jacketed cylinder of an ironing roll employing an inner cylinder jacket having a converging end portion. The latter is in combination with a chamber-defining end ring welded between the ends of concentric cylinders of such ironing roll as will hereinafter be explained in greater detail.

The above and other objects of this invention will become apparent from the following detailed description when read in the light of the drawing and appended claims.

SUMMARY OF THE INVENTION

In one embodiment of this invention, longitudinal end portions of concentric cylinders defining a jacketed ironing roll are connected to a slotted torus or toroidal segment defining an expansion joint, in combination with an anchor ring. The ring is welded at right angles at its outer periphery to the inner periphery of an end portion of the larger-diameter cylinder defining the ironing roll. A pipe "doughnut" or torus has a surface segment of preferably about 105° uniformly and concentrically removed 360° about the entire torus circumference, resulting in a toroidal segment having a uniform arcuate transverse cross-section of about 255°. The free edges of such segment are welded to the ring edge defining the inner diameter of the anchor ring and the end of the inner cylinder, forming one end of a liquid-tight annular circulating chamber. The inner cylinder which is heated by direct flame impingement and normally expands prior to the outer cylinder, is able to expand relative to the outer cylinder, resiliently deforming the annular seal defined by the toroidal pipe segment and anchor ring as will hereinafter described in greater detail.

BRIEF DESCRIPTION OF THE DRAWINGS

For a more complete understanding of this invention reference will now be made to the drawings wherein:

FIG. 2 is an elevational view of a pipe member; employed in the formation of the joint of this invention in an initial stage of formation;

FIG. 3 is an elevational view of two pipe members such as illustrated in FIG. 2 following removal of terminal end portions thereof and the welding of such members into a torus as illustrated;

FIG. 4 is a transverse sectional view of the pipe torus of FIG. 3 after an arcuate segment has been uniformly removed about the entire torus circumference;

FIG. 5 is a fragmentary somewhat schematic view illustrating a toroidal expansion joint made in accordance with this invention welded in place between inner and outer cylinders of a cylinder ironer;

FIG. 6 is a fragmentary perspective view of an end portion of a jacketed ironing cylinder roll employing the expansion joint of this invention;

FIG. 7 is a perspective view of a toroidal expansion joint made in accordance with this invention after an arcuate section indicated in FIG. 4 has been uniformly removed about its entire circumference, and FIG. 8 is an elevational view partly in section illustrating a modified expansion joint made in accordance with this invention.

DESCRIPTION OF THE PREFERRED EMBODIMENTS

Figure 1:
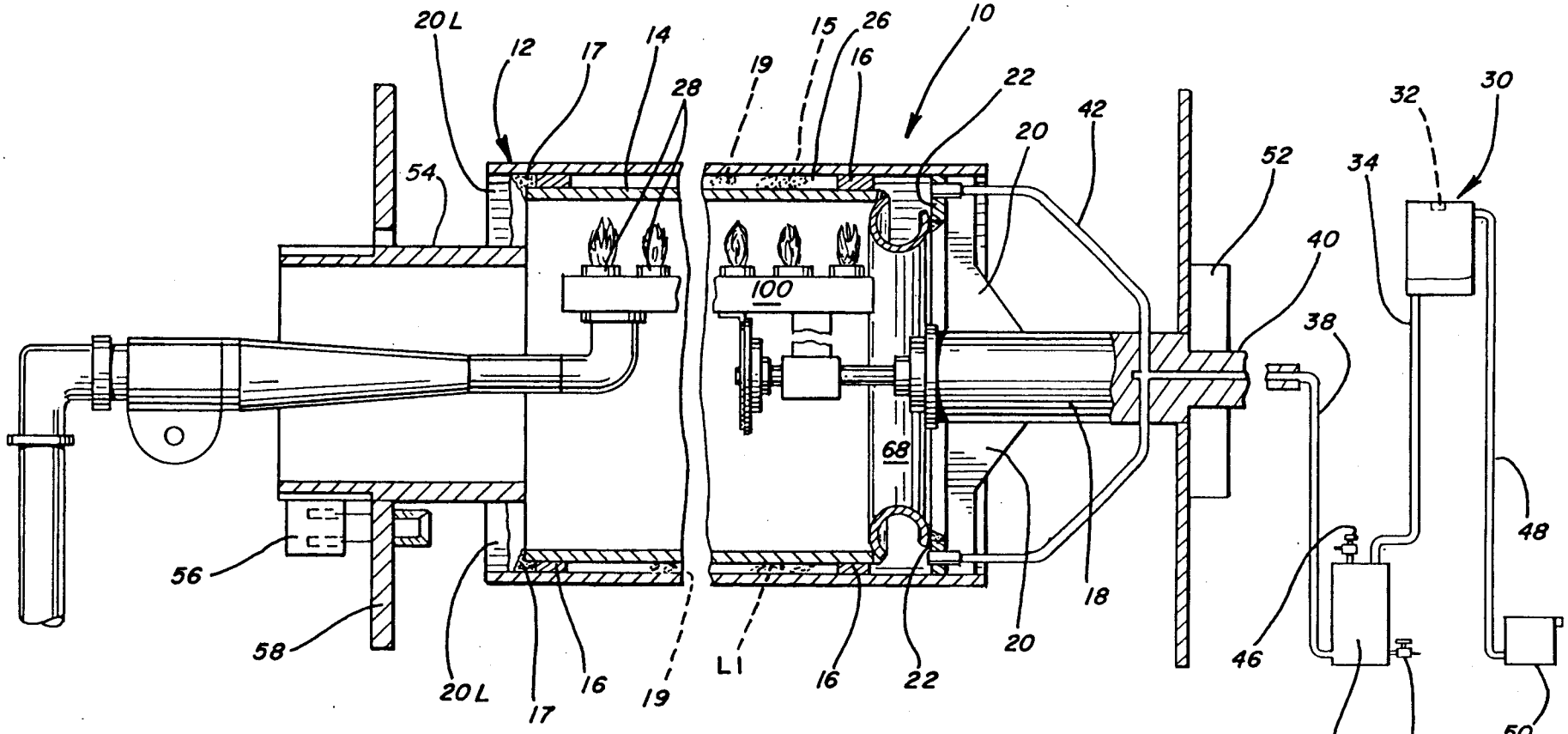
FIG. 1 is a fragmentary longitudinal view, partly in section, illustrating a rotatable ironer comprising jacketed cylinders employing the expansion joint of this invention.

Referring now more particularly to FIG. 1, an ironing roll 10 is therein fragmentarily illustrated in longitudinal section and partly in elevation. Such ironer is of a type sold under the trade name Ultra-Therm by Chicago Dryer Company of Chicago Illinois and comprises an outer metal cylinder 12 maintained in spaced concentric relationship with an inner metal cylinder 14 as by means of spacer elements 16 which may be in the form of blocks, which are welded or otherwise secured to the inner periphery of outer cylinder 12 at opposed ends, and preferably spaced apart and secured at 90° intervals about the periphery of the cylinder 12. Annular weld 17 secures the two cylinders together at the left roll end as seen in FIG. 1 and forms a fluid seal between the cylinders. Ironing roll 10 is mounted for rotation on a shaft 18 with the assistance of support vanes or plates 20 connected to shaft 18 at spaced intervals about the shaft periphery and secured to outer cylinder 12 of the roll 10. It will be noted from FIG. 1 that the intermittent support plates 20 are also secured as by welding or the like to end anchor ring 22 illustrated in section in FIG. 1. Anchor ring 22 is welded about its outer periphery to the inner periphery of the outer cylinder 12 as illustrated so as to be disposed at substantially right angles to such inner cylinder periphery.

The two concentric cylinders 12 and 14 of the ironer roll 10 together with opposed annular seals define an annular circulating chamber 26 through which a thermal liquid is adapted to circulate for purposes of heating outer cylinder 12. Outer cylinder 12 possesses an outer, polished, finishing surface which engages the sheet or the like to be ironed, and contacts on its inner periphery a heated thermal liquid circulating within the roll chamber 26. The liquid in the chamber 26 is heated by a means of gas flames emanating from spaced burner outlets 28 disposed along the length of burner manifold 30 as illustrated in FIG. 1. It is apparent from FIG. 1 that the flames emanating from the spaced outlets 28 impinge against the inner surface of the inner cylinder 14 whereafter heat conducted through the thickness of cylinder 14 passes to the liquid body L1 circulating in the liquid flow chamber 26 defined by the concentric cylinders of the ironing roll.

The thermal liquid employed in the ironing roll 10 passes from upper fluid supply tank 30 schematically illustrated in FIG. 1 and having breather-filler cap 32 therein. Thermal liquid passes from tank 30, by means of conduit 34 and lower fluid reservoir 36 into conduit 38 for passage into rotary union 40 for entry into conduit arm 42 for passage into fluid passageway 26 of the ironing roll. It will be noted from FIG. 1 that the lower fluid reservoir 36 has a drain valve 44 for periodically removing thermal liquid from the system as desired. Reservoir 36 also has an air bleed valve 46 for assisting in removal of air from the system. If in the normal course of operation the expansion of the thermal liquid becomes so great as to overflow upper tank 30, the excess liquid may pass by means of conduit 48 into an overflow holding tank 50.

The right end of ironer roll 10 is mounted in a manner well known in the art in a bearing plate 52 which supportably engages rotary shaft 18. The opposite end of the roll assembly includes support cylinder 54 which supportably engages cylinders 12 and 14 by concentric support vanes 20L preferably intermittently arranged at regular intervals about the periphery of support cylinder 54. Cylinder 54 rotatably engages supporting rollers 56 mounted in a support plate 58 as illustrated. Such support structure is well known in the art and comprises no part of this invention.

It is apparent from FIG. 1 that as the gas flames of burner header 100 initially impinge against the inner periphery of inner cylinder 14. The latter cylinder will initially expand in accordance with its coefficient of expansion relative to the outer polished cylinder 12. The latter is eventually heated to operating temperature by means of the thermal liquid circulating in the passageway 26 between the concentric cylinders. As it is essential that the cylinder system be free from leaks for obvious reasons such as soiling of the laundry being processed, it is necessary that the joints between the inner and outer cylinders be fluid tight.

It will be noted from FIG. 1 that the cylinder assembly at the left end of the roll 10 is substantially stable. As the cylinders 12 and 14 are peripherally welded together 360° by weld 17. Accordingly, any expansion taking place in the cylinders extends to the right as illustrated in FIG. 1. As above noted, since inner cylinder 14 is initially heated it will tend to longitudinally expand to the right in advance of any expansion of outer cylinder 12. To maintain the liquid-tight integrity of the concentric cylinders defining the ironing roll 10, expansion joint 68 is interposed the free, movable end of inner cylinder 14 as illustrated in FIG. 1 and the inner diameter of anchor ring 22 mounted at right angles in fluid tight engagement with the inner periphery of the outer cylinder 12 as is also clearly illustrated in FIG. 1.

Expansion joint 68 comprises a toroidal or hollow "doughnut" segment welded in fluid-tight engagement to the inner cylinder and anchoring ring as previously noted.

The joint 68 of which only one half is illustrated in elevation in the sectional view of FIG. 1 is formed from two pipe sections such as illustrated in FIG. 2. Each section is bent uniformly through an arc of approximately 200° as illustrated in FIG. 2 about a center of curvature. The opposed end portions are subsequently removed so as to form a substantially perfect 180° arc as it has been found that if it were attempted to bend a pipe length through 180° the anchored ends thereof are often deformed in the course of the bending operation. As a result, the ends do not have a desired circular cross section as is desired throughout the length of the pipe.

Two pipe members such as pipe member 64 illustrated in FIG. 2, are thus formed, whereafter the ends are trimmed to form two 180° arcs. The ends of the 180° arcuate pipes are then welded or otherwise fixedly secured together as illustrated in FIG. 3, so as to form a doughnut or torus 66. The toroidal pipe is then mounted on a lathe for removal of a circumferential segment of approximately 105° as illustrated in FIG. 4 whereby the torus 66 has a uniform, radially-transverse cross section of approximately 255°. It is preferred that the removed segment comprise an arc between about 95° and 115° although other size segments will result in a joint which will work to advantage when combined with ironer elements of particular size as will be apparent to those skilled in the art.

The resulting toroidal segment transverse section 68 illustrated in FIG. 4 has the appearance in elevation as illustrated in the perspective view of FIG. 7. Toroidal segment 68 in FIG. 7 is adapted for welding in place between the inner end of inner cylinder 14 and inner edge portion defining the opening in anchor ring 22 as illustrated in FIG. 1.

The enlarged fragmentary sectional view of FIG. 5 illustrates the welded connection between the toroidal expansion joint 68 and the inner cylinder 14 at 70. Such weld is continuous about the 360° connection between the two illustrated elements. Similarly, continuous weld 72 maintains a 360° liquid-tight connection between an end portion of the toroidal segment joint 68 and inner peripheral portion of the anchor ring 22 is also clearly illustrated in FIG. 5.

It is seen from FIG. 5 that longitudinal expansion of inner cylinder 14 relative to outer cylinder 12 will result in partial closing of the approximately 105° gap or slot formed about the circumference of the pipe torus as free edge F of joint 68 moves in the direction for anchor ring 22. It will be further noted from FIG. 5 that a joint portion adjacent edge F2 of joint 68 abuts anchor ring 22 at P which is opposed to a joint portion located substantially on the pipe diameter of the joint transverse section illustrated. Such relative arrangement of contact points assures maximum strength in the pipe joint and enables the same to desirably resiliently enlarge upon cooling of cylinder 14. It is also seen from FIG. 5 that the pipe portion removed comprises approximately 25° of the upper left quadrant of the illustrated transverse section plus a contiguous 80° of the upper right quadrant.

FIG. 6 is an end elevational view partly broken away, of the ironer roll outer cylinder 12 welded to anchor ring 22 which is in turn welded at its inner circumference 360° adjacent distal arcuate edge portion F2 of the toroidal joint 68. (See FIG. 5). The opposite edge of the toroidal joint is welded in fluid-tight engagement with terminal end of inner ironer cylinder 14.

It is believed apparent from FIG. 1 and FIG. 5 of the drawing that with the initial expansion of inner cylinder 14 and the elongation thereof relative to an as yet unheated outer cylinder 12, the inner cylinder must move relative to the outer cylinder. Such relative movement is absorbed at the joint 68 by appropriate flexing of the joint. A portion of the cylinder elongation may also be absorbed in part by movement of anchor ring 22. It has been found that radial movement of cylinder 14 relative to cylinder 12 is insignificant in the structure illustrated.

FIG. 8 is a perspective view of a modified joint construction which does not employ a toroidal joint but rather utilizes a modified inner cylinder 14M, having a tapered distal end portion. The latter is uniformly tapered 360° about its periphery and is welded in fluid-tight engagement with inner diameter-defining portion of anchor ring 22M. In the course of the initial heating of cylinder 14M, the beveled or cammed end terminal portion T will force anchor ring 22M to flex or bend to the right as bend to the right as illustrated in FIG. 8. Thus the inner cylinder movement may be absorbed as the cammed end portion T of the inner cylinder tends to elongate as illustrated in phantom lines.

It is thus seen that a thermal fluid flatwork ironer has been provided which employs a novel expansion joint disposed between the ends of concentric cylinders and adapted to eliminate the undesired leaking of thermal liquid in the normal course of ironer roll operation. It is obvious that with each start-up of an ironer of the type above described, relative expansion takes place between the inner and outer cylinders defining the ironing roll. Such repeated expansions and contractions unless compensated for, ultimately result in liquid leakage rendering the ironer inoperable as the processed laundry will be soiled if not permanently ruined, until the leaks have been eliminated.

The thermal liquid ironer described because of its outstanding heat continuity and distribution assures a consistent high-quality finish on the ironed flatwork. The described ironer is adapted for high production although occupying limited floor space and is of extremely rugged design having a long desired work life.

By way of example, the outer roll cylinder 12 may have a 28 inch outer diameter, and the inner cylinder 14 may have an outer diameter of approximately 27 inches. The cylinders may be formed of ASTM 516 grade 70 steel, and have thicknesses of approximately 0.5 inch and 0.375 inch, respectively. The toroidal expansion joint may be formed from four inch pipe formed of ASTM SA 106 grade 70 steel. The anchor ring 22 may have an inner diameter of approximately 22 inches.

It is apparent that the expansion joint need not have a perfectly circular cross section, and the resulting joint construction would work to advantage if assembled with the components previously described in the manner described. The material of fabrication from which the anchored toroidal joints and anchor rings are formed may have a resiliency whereby a bent portion hereof seeks to return to an original position. The material of fabrication from which the joint and rings are formed may also be ductile or non-resilient having little or no resiliency whereby the particular configurations thereof are dictated by the position of the components to which said joint and ring are attached.

Also, in the embodiment illustrated in FIG. 8, the cammed in end portion of the inner ironing cylinder 14M may be formed by removing "darts" of the thickness of the end portion of the cammed-in cylinder end uniformly about its periphery. Such removal facilitates the inward bending of the cylinder end whereafter the notched portions of the cylinder are welded so as to insure a continuous periphery free of leak causing fissures.

Helical guide blades such as disclosed in Kober U.S. Pat. No. 4,418,486 and assigned to the assignee of this invention may also be incorporated between the cylinders 12 and 14 for assisting in the desired uniform liquid distribution of the thermal liquid in the roll circulating chamber 26. The disclosure of said patent is incorporated herein by reference. Such a blade 15 is illustrated in phantom line in FIG. 1. Desired uniform distribution of the thermal liquid in chamber 26 may also be assisted by ball bearings 19 also illustrated in phantom line in the FIG. 1. The bearings rotate within the confines of the blades in the normal course of roll rotation.

It is believed apparent the dimensions and materials of fabrication presented above by way of example may be changed and varied without departing from the ambit of the invention disclosed. Also, other modifications apparent to those skilled in the art may be made of the apparatus above described, which modifications will remain within the ambit of the invention disclosed. It is intended therefore that this invention is to be limited only by the scope of the appended claims.

What is claimed is:

1. An ironer construction comprising substantially concentric cylinders of different diameters having opposed longitudinal ends and defining a cylindrical passageway therebetween through which a fluid heating medium may circulate; means secured to one longitudinal end of each of said cylinders for securing said cylinders together and maintaining a fluid-tight seal between said cylinders at said one longitudinal end of each of said cylinders; heating means for heating the interior of the cylinder of smaller diameter whereby heat may be conducted through the smaller-diameter cylinder to a fluid heating medium in said cylindrical passageway; means for allowing longitudinal movement of the smaller diameter cylinder relative to the larger diameter cylinder while maintaining a fluid-tight seal between said cylinders at second longitudinal ends of said cylinders oppositely disposed to said one ends; said means for allowing longitudinal movement comprising a toroidal segment disposed within said larger diameter cylinder and having substantially concentric first and second free edges defining a slot about the circumference of said segment; said toroidal segment being welded in fluid-sealing engagement to the second longitudinal end of the smaller diameter cylinder along said segment first free edge; an anchor ring having concentric inner and outer peripheries and welded along its outer periphery in fluid-sealing engagement to the inner periphery of the larger diameter cylinder, and said toroidal segment being welded along tis second free edge in fluid-sealing engagement to the inner periphery of said anchor ring whereby movement of said smaller diameter cylinder relative to said larger diameter cylinder occurring during expansion of said smaller diameter cylinder results in flexing of said toroidal segment as the slot thereof is narrowed.

2. The expansion joint of claim 1 in which said toroidal connecting means is formed of two cylinders of uniform diameter each of which is first bent approximately 200° uniformly about a center of curvature whereafter opposed distal end portions of the bent cylinders are removed so as to form cylinders bent uniformly about a center of curvature and defining an arc of 180° whereafter the distal ends of said bent cylinders are joined together to form a torus.

3. The ironer construction of claim 1 in combination with means for rotatably mounting and rotating said cylinders, and means in said cylindrical passageway for uniformly distributing a fluid heating medium therein in the normal course of cylinder rotation.

4. The ironer construction of claim 1 in which said toroidal segment is formed of an resilient material of fabrication.

5. The ironer construction of claim 1 in which said toroidal segment is formed of a non-resilient material of fabrication.

6. The ironer construction of claim 1 in combination with spacer means affixed to one of said cylinders and disposed in said cylindrical passageway for assisting in maintaining said cylinders in concentric relation.

7. The ironer construction of claim 1 in which said toroidal segment edges are disposed between about 95 and 115 degrees apart in a radially transverse section of said toroidal segment.

8. A method of forming a resilient fluid-tight seal between the ends of concentric cylinders of different diameters comprising the steps of forming two tubular members of uniform diameter uniformly, approximately 200 degrees about a center of curvature; removing end portions of said formed tubular members to form tubular members formed through an arc of approximately 180 degrees; welding the ends of said tubular members together to form a torus; uniformly removing a peripheral segment about the entire torus circumference so as to form a toroidal segment having spaced edges defining a slot about the entire circumference thereof, and connecting the ends of said concentric cylinders in fluid-tight engagement to spaced portions of said toroidal segment adjacent said spaced edges of slot.

* * * * *